United States Patent [19]

Hutchinson

[11] 4,004,686

[45] Jan. 25, 1977

[54] MATCH BOOK

[76] Inventor: Francis M. Hutchinson, 460 Elm St., Stratford, Conn. 06497

[22] Filed: Nov. 28, 1975

[21] Appl. No.: 636,085

[52] U.S. Cl. ..... 206/104; 206/107; 206/115

[51] Int. Cl.[2] ..... A24F 27/00

[58] Field of Search ..... 206/85, 90, 92–93, 206/96, 104, 106–109, 111, 115

[56] References Cited

UNITED STATES PATENTS 2,105,425 1/1938 Lee ..... 206/107

2,337,305 12/1943 Arenson ..... 206/107

*Primary Examiner*—Steven E. Lipman

*Attorney, Agent, or Firm*—Arthur T. Fattibene

[57] ABSTRACT

A match book construction comprising a base member to which a row of upwardly extending matches are secured and a cover member which is adapted to be removably connected to the base member, the arrangement being such that the heads of the matches are completed shielded prior to igniting a match thereon.

4 Claims, 4 Drawing Figures

MATCH BOOK

PROBLEM

Present day paper match books generally comprise a cover member which is folded over the matches. Usually such covers are formed integral with the base portion of the match book in the form of a flap which folds over the matches when closed. To dispense and light a match, the flap must first be opened and the match removed from the book. Such match books have a striking element of a suitable abrasive material connected to the base position. However, it frequently happens many users neglect to close the cover flap prior to attempting to ignite the match. As a result, it often happens that the remaining exposed matches are accidentally ignited which can and has resulted in serious injury to the user. Even when the flap was closed, ignition was still possible because the ends were generally exposed. Also such flap type paper match books are widely used as an advertising medium in that the front and back portions of the match book is provided with copy directed to a particular product or service. Thus, the available advertising space was limited to the flap and/or back side of the cover; the ends of the cover being open.

Heretofore various efforts have been made to obviate the foregoing noted hazard. For the most part, the known efforts required relatively complex and/or radical reconstruction of the match book, which constructions have been either too costly and/or complex in comparison to the well known flap type paper match books. Some of the prior known efforts employed cover constructions which were either laterally slideable or pivotally connected for exposing the matches. Other systems required that the conventional flap type book matches be encased in an outer enclosure which was generally formed of a plastic or metal and thereby added to the cost of a simple paper match book.

OBJECTS

An object of this invention is to provide a novel paper match book construction which is arranged so as to completely protect the matches from accidental ignition.

Another object is to provide a match book in which the cover portion is readily detachably connected relative to the matches.

Another object is to provide a match book in which the cover must be closed before a user can light a match thereon.

BRIEF SUMMARY OF THE INVENTION

The foregoing objects and other features and advantages are attained by a match book construction which comprises a base member to which the row of matches are secured, and a cover member which is formed so as to completely encase the matches extending beyond the base member. The cover member is defined by opposed side and end walls, and a connected top wall to form an enclosure which can be readily fitted over the matches. The cover member is detachably secured to the base member by frictionally inserting the end of the cover member between the base member and the base of the matches.

Disposed on the cover member or the base member is a striking element of a suitable abrasive for effecting the ignition of a match when the head of the match is rubbed thereon. The arrangement is such that when the cover member is assembled to the base, all of the matches are totally encased within the enclosure or cover member, thereby prohibiting any possibility of accidental ignition when a match is ignited upon rubbing thereof along the striking element.

FEATURES

A feature of this invention resides in the provision of a paper match book cover in which the matches are totally enclosed by a protective cover so as to prevent any accidental ignition of the matches.

Another feature resides in the provision of a match book cover which is constructed in a manner which provides for the placing of additional advertising material thereon.

Another feature resides in the provision of a paper match book having a cover construction which requires the cover to enclose the matches before ignition of a match is possible.

Other features and advantages will become more readily apparent when considered in view of the drawings and specification in which.

DETAILED DESCRIPTION

Figure 1:
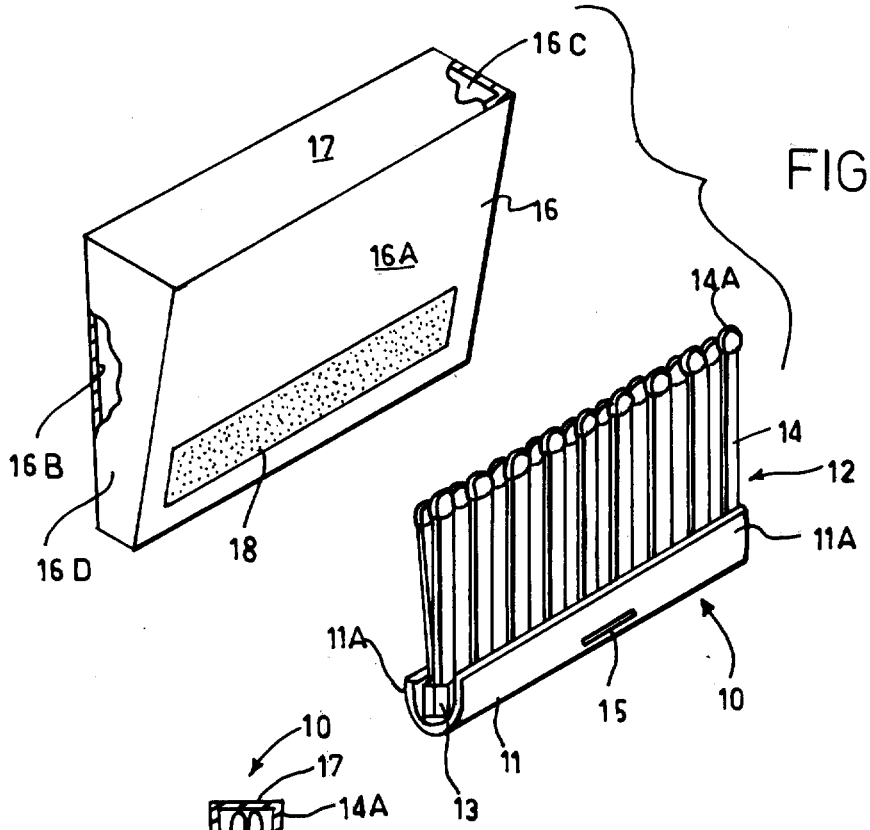
FIG. 1 is an exploded perspective view of a match book embodying the invention.
Figure 3:
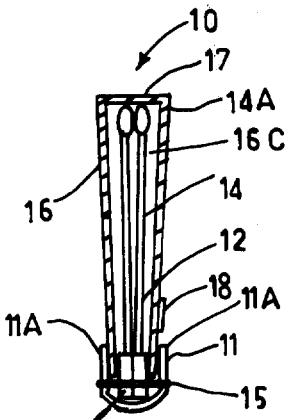
FIG. 3 is a sectional view taken along line 3—3 on FIG. 2.
Figure 2:
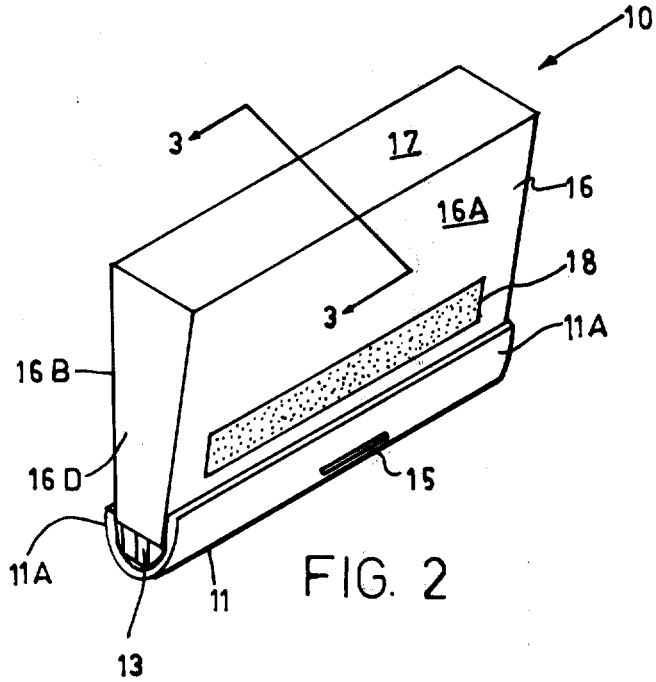
FIG. 2 is a perspective assembled view of FIG. 1.

Referring to the drawings, there is shown in FIGS. 1 to 3 a match book construction 10 embodying the invention. The illustrated embodiment includes a base member 11 which is generally U shaped having opposed leg portions 11A—11A. The base member 11 is formed of paper or thin cardboard as is well known in the art. Secured between the opposed leg portions 11A, 11A of the base member 11 is a row of matches 12. The row of matches includes a web portion 13 to which there is connected a plurality of closely spaced matches 14 which includes the stem and connected match heads 14A. As shown, the means for securing the web 13 of the match row 12 between the opposed leg portions 11A, 11A comprises a staple 15 or other suitable fastener. It will be noted that the staple extends through the base member 11 and the web 13 intermediate the height thereof. Accordingly, the upper end of the respective leg portions 11A, 11A is disposed contiguous to the web 13 and will bear against to web 13 to frictionally secure a readily removeable cover member 16 as will be hereinafter described.

As shown in FIGS. 1 to 3, the cover member 16 comprises a pair of opposed side walls 16A, 16B and opposed end walls 16C, 16D interconnected therebetween. A top wall 17 completes the cover member. Thus the cover member defines an enclosure which in the assembled position forms a complete enclosure for the matches in the assembled position as shown in FIGS. 2 and 3.

To secure the cover member 16 in the assembled position, it will be noted that the lower end portion of the respective side walls is frictionally inserted between the web portion 13 and the contiguous leg portions 11A, 11A of the base member.

As seen in FIGS. 1 to 3, at least one side wall 16A of the cover member 16 is provided with a striking element 18. The striking element 18 comprises a strip or zone containing a suitable abrasive material to define a strike means for ignition of a match. With the construction described the cover member 17 must be in the assembled position, as shown in FIGS. 2 and 3 before the match can be conveniently ignited by rubbing on the striking element 18.

To remove a match for use, one simply has to lift the cover member 16 from the base member 11 simply by exerting a force sufficient to overcome the frictional force retaining the cover member in the assembled position, and tearing one of the matches 14 from the web 13. Upon replacing the cover member, the removed match 14 can be ignited by striking it against the striker element 18. With the remaining matches in the match row 12 completely enclosed when the removed match is ignited; accidental ignition of the covered matches is completely avoided.

Also because of the end walls 16C and 16D, additional advertising area is provided in the event such match books are intended to be used for advertising a product or service.

For economy of production, the entire base member and cover member can be formed of paper or cardboard of the type commonly used to make paper match books.

Figure 4:
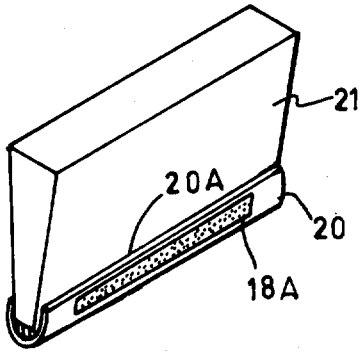
FIG. 4 is a modified embodiment.

FIG. 4 illustrates a modified embodiment. This embodiment includes a base member 20 and a cover member 21 similar in all respects to that hereinbefore described. The embodiment of FIG. 4 differs from that of FIGS. 1 to 3 only in the location of the striking element 18A. As shown in FIG. 4, the striking element 18A is located on the leg portion 20A of the base member 20. In all other respects the operation and structure of the embodiment of FIG. 4 is similar to that described with respect to FIGS. 1 to 3.

While the particular invention has been described with respect to several particular embodiments, it will be appreciated that variations and modifications may be made without departing from the spirit or scope of the invention.

What is claimed is:

1. A match book comprising, a substantially U-shaped base member having opposed leg portions, a row of matches secured to said base member between said opposed leg portions, said matches extending beyond the opposed leg portions of the said base member, a cover member detachably connected to said base member, said cover member defining an enclosure for encasing the matches, said cover member including opposed side walls, interconnected end walls, and a top wall for encasing said matches, said cover member being frictionally secured to said base member by insertion of the lower portion of said side walls between the leg portions of said base member and said row of matches disposed therebetween, and means defining a striking element for effecting ignition of said matches connected to one of said member.

2. The invention as defined in claim 1 wherein said striking element is attached to the exterior portion of one of said side walls of said cover member.

3. The invention as defined in claim 1 wherein said striking element is attached to the exterior portion of one of the leg portions of said base member.

4. A paper match book comprising a substantially U-shaped base member having opposed leg portions, a row of matches, said row of matches including an elongated web and a plurality of upwardly extending matches detachably connected to said web, said web being disposed between said opposed leg portions, means for securing said web to said base member at an intermediate point, whereby said matches extend upwardly beyond said base member, and a cover member detachably connected to said base member, said cover member including opposed side walls, connected end walls, and a top wall to define an enclosure for said matches, said side walls being inserted and frictionally held between the web and adjacent leg portions of said base member in the assembled position, and a striking element connected to the exterior surface of one of said side walls of said cover member whereby said cover member is normally required to be secured to said base member in shielding relationship with said matches before a match can be ignited.

* * * * *